US008430484B2

(12) United States Patent
Fang

(10) Patent No.: US 8,430,484 B2
(45) Date of Patent: Apr. 30, 2013

(54) NOZZLE COVERING FOR EJECTION CHIPS IN MICRO-FLUID APPLICATIONS

(75) Inventor: Jiandong Fang, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 303 days.

(21) Appl. No.: 12/824,358

(22) Filed: Jun. 28, 2010

(65) Prior Publication Data

US 2011/0316932 A1 Dec. 29, 2011

(51) Int. Cl.
*B41J 2/05* (2006.01)

(52) U.S. Cl.
USPC ..... 347/65; 347/47; 347/40; 347/63

(58) Field of Classification Search ..... 347/65, 347/63, 47, 40
See application file for complete search history.

*Primary Examiner* — Matthew Luu
*Assistant Examiner* — Henok Legesse

(57) ABSTRACT

A micro-fluid ejection head conveys fluid to firing elements at differing heights in differing layers. The ejection head includes a base substrate. The firing elements are configured on the substrate to eject fluid upon activation. Individual elements are arrayed closer or farther to a common fluid via. A multiple-layer covering on the substrate defines nozzles openings corresponding to each firing element. A lower layer of the covering directs fluid to either the closer or farther elements while a higher layer directs fluid to the other elements. The lower and higher layers define channels to direct the fluid from the fluid via. The higher layer covers the channels in the lower layer, while a topmost layer covers the channels in the higher layer. Also, the topmost layer defines the nozzle openings in large and small opening sizes. Holes in the underlying layers register with the nozzle openings, but are oppositely sized.

20 Claims, 7 Drawing Sheets

*a:* nozzle pitch, *b:* chamber diameter, *c:* choke width, *d:* layer overlap

*2a = b + c + 2d*

Typically, *b=17μm*, *c=14μm*, and *d=4μm* ( This can be smaller due to improved adhesion between polymers with close CTE).

Then *a = 19.5μm* corresponding to 2605 dpi in single-pass print resolution when all four rows of heaters are taken into account.

NOZZLE COVERING FOR EJECTION CHIPS IN MICRO-FLUID APPLICATIONS

FIELD OF THE INVENTION

The present invention relates to micro-fluid ejection devices, such as inkjet printers. More particularly, although not exclusively, it relates to chips of ejection heads having nozzle covers for fluid firing elements, such as inkjet heaters. The covers define multiple layers of fluid flow from a fluid via.

BACKGROUND OF THE INVENTION

The art of printing images with micro-fluid technology is relatively well known. A permanent or semi-permanent ejection head has access to a local or remote supply of fluid (ink). The fluid ejects from an ejection zone to a media in a pattern of pixels corresponding to images being printed. Over time, the fluid drops have become smaller for higher resolutions. The firing elements to energize ejections have correspondingly decreased in both size and spacing as have the thin-film layers embodying them in ejection chips.

Reductions of this type, however, have come at a cost of increased fragility to the chips. Smaller sizes, smaller spacing, etc., also translates into lesser structural area for assembly, such as having sufficient available space for bonding to other surfaces. In certain devices with 1800 dpi (dots-per-inch) imaging resolution, neighboring nozzles of chips require a separation distance of 28.2 μm. They accommodate flow feature "real estate" between the nozzles at a width of at least 11 μm. To get higher resolutions, flow feature width necessarily requires shrinking. However, shrinking too much impractically limits the amount of real estate available for adhesion and weakens mechanical strength of the nozzle covering.

Accordingly, a need exists to increase imaging resolution, but not at cost to strength or structural surfaces for bonding. The need extends not only to final assemblies, but to manufacturing processes. Additional benefits and alternatives are also sought when devising solutions.

SUMMARY OF THE INVENTION

The above-mentioned and other problems become solved with the proposed nozzle covering for ejection chips in micro-fluid applications. Broadly, the nozzle covering has multiple layers conveying fluid to firing elements at differing heights in differing layers. Manufacturability in different layers can accommodate large spacing between adjacent fluid channels for good mechanical strength in the nozzle cover and space for adhesion to adjacent surfaces. Spacing between individual firing elements can be made small enough to achieve imaging resolutions of greater than 2500 dpi in a single pass.

In a representative embodiment, the ejection head includes a base substrate. The firing elements are configured conventionally on the substrate to eject fluid upon activation. Individual elements are arrayed closer or farther to a common fluid via formed through the substrate. The covering defines nozzles openings corresponding to each firing element. A lower layer of the covering directs fluid to either the closer or farther elements while a higher layer directs fluid to the other elements. The lower and higher layers both define spaced channels to direct the fluid from the fluid via. The higher layer covers the channels in the lower layer, while a topmost layer covers the channels in the higher layer. Also, the topmost layer defines the nozzle openings in both large and small opening sizes. Holes in the underlying layers register with the nozzle openings, but are oppositely sized. Bubble chambers in the lower layers also register with the nozzle openings. The chambers and the smaller of the nozzle openings or holes in the many layers define the fluid droplet size.

Methods to form the covering on the substrate include laminating and lithographically patterning various polymer layers. Calculating nozzle pitches and spatial density are still other embodiments. Printing resolutions are defined.

These and other embodiments will be set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. Also, the term wafer or substrate includes any base semiconductor structure, such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures hereafter devised or already known in the art. The following detailed description, therefore, is not to be taken in a limiting sense and the scope of the invention is defined only by the appended claims and their equivalents. In accordance with the present invention, methods and apparatus include nozzle coverings for ejection chips in a micro-fluid ejection head, such as an inkjet printhead.

Figure 1:
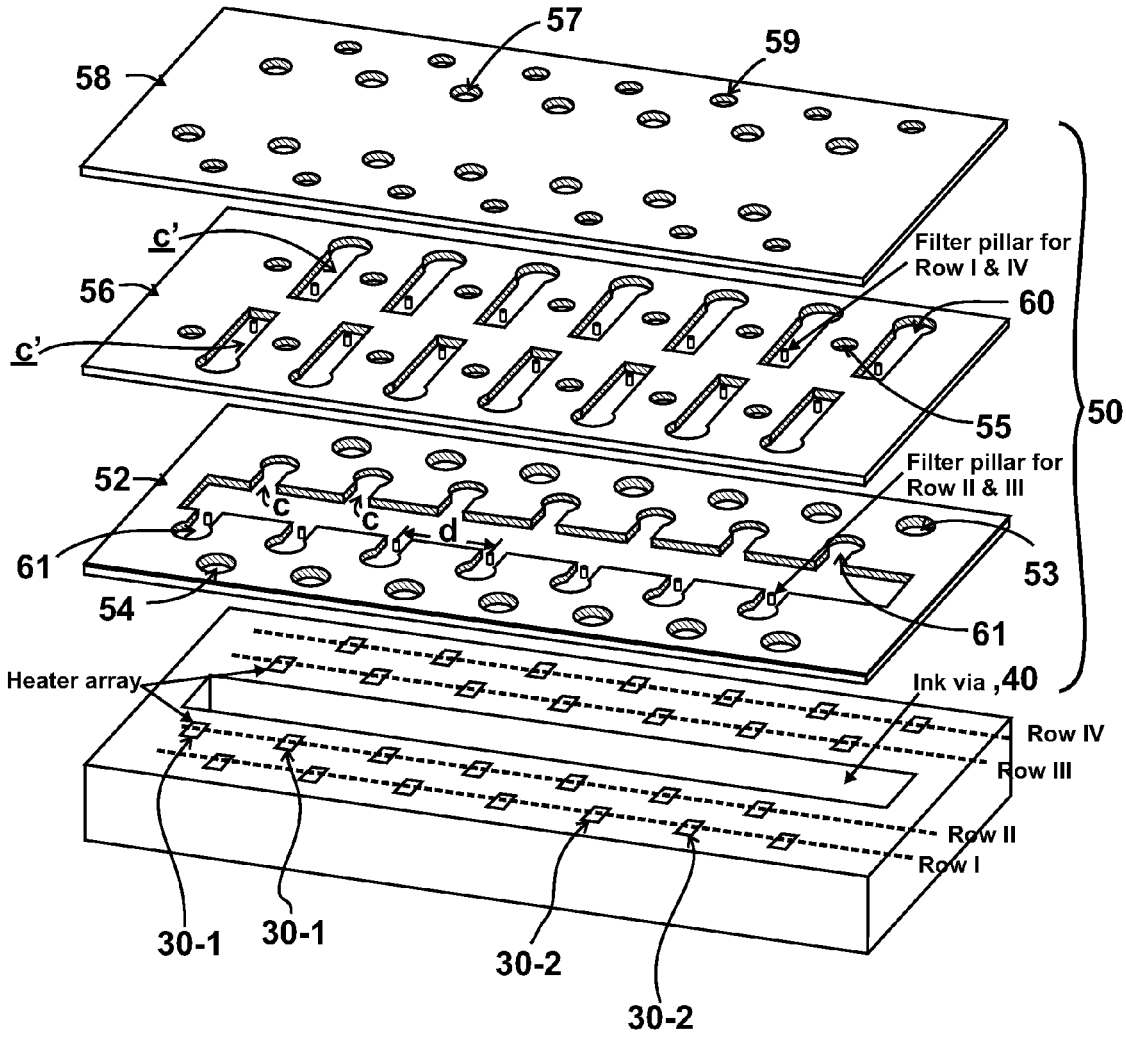
FIG. 1 is an exploded view in accordance with the teachings of the present invention of a nozzle covering for a micro-fluid ejection head.

With reference to FIG. 1, a base substrate 20 includes pluralities of fluid firing elements 30. The elements are any of a variety, but contemplate resistive heaters, piezoelectric transducers, or the like. They are formed on the substrate through a series of growth, patterning, deposition, evaporation, sputtering, photolithography or other techniques. The elements are arrayed closer or farther to a common fluid (ink) via 40. The color of fluid corresponds to a source of ink (not shown), such as cyan, magenta, yellow, or black.

The elements exist in Rows I-IV. Rows I and IV contain firing elements farther away from the fluid via. Rows II and III, on the other hand, contain elements closer to the fluid via.

The spacing between adjacent elements is substantially even per each row and between rows. Upon activation, the elements cause the ejection of fluid at times pursuant to commands of a printer microprocessor or other controller, as is known. The timing corresponds to a pattern of pixels of an image being printed on a media.

Above the substrate, a covering 50 defines nozzle openings for each of the firing elements to eject the fluid toward the media. It also defines flow features (channels C) to direct ink from the fluid via to each of the individual elements. The covering defines each of these elements in pluralities of layers.

In a lower layer 52, the covering directs fluid in relatively short channels C to the closer firing elements 30-1. In a higher layer (the medium layer 56), the covering directs fluid in relatively long channels C' to the farther elements 30-2. The medium layer 56 covers channels in the lower layer, while a highest (upper) layer 58 covers the channels in the medium layer. Covering from one layer to the next keeps ink from spilling and serves to direct it transversely, in two heights above the substrate, to individual elements where it is ejected during imaging. Alternatively, the lower and higher layers can be oppositely configured to direct fluid to the farther and closer elements, respectively. In either design, distances (d) exist between adjacent channels (per a given lower or medium layer) that are twice as wide as otherwise would occur in a single layer commonly flowing fluid to all firing elements. Hence, each layer has more "real estate" between neighboring flow features. It results in higher mechanical strength of the chip and more room for adhering surfaces together. The latter also reduces the possibility of delaminating the cover from the underlying substrate.

In addition, the topmost layer defines its nozzle openings in both large and small opening sizes 57, 59. Holes 53, 55 in the underlying layers register with the nozzle openings, but are oppositely sized. The smallest diameter of the nozzle openings or holes in the many layers, along with its corresponding bubble chamber, sets the fluid droplet size. As is seen, ink flows from an ink source through the substrate at via 40. It flows transversely in channels C to either the close or far firing elements 30-1, 30-2 through the lower or medium layer. The ink ejects from the cover 50 in one of two ways. For the close firing elements, ink passes upward through the bubble chamber 61 at the terminal end of the channel C. It flows upward through a relatively small hole 55 registered in the medium layer. It then passes through a large opening 57 in the upper layer 58. For the far firing elements, ink passes upward through the bubble chamber 60 at the terminal end of the channel C'. (Bubble chamber 60 is registered with the relatively large hole 53 in the lower layer 52.) It then passes through a small opening 59 in the upper layer 58.

Figure 2:
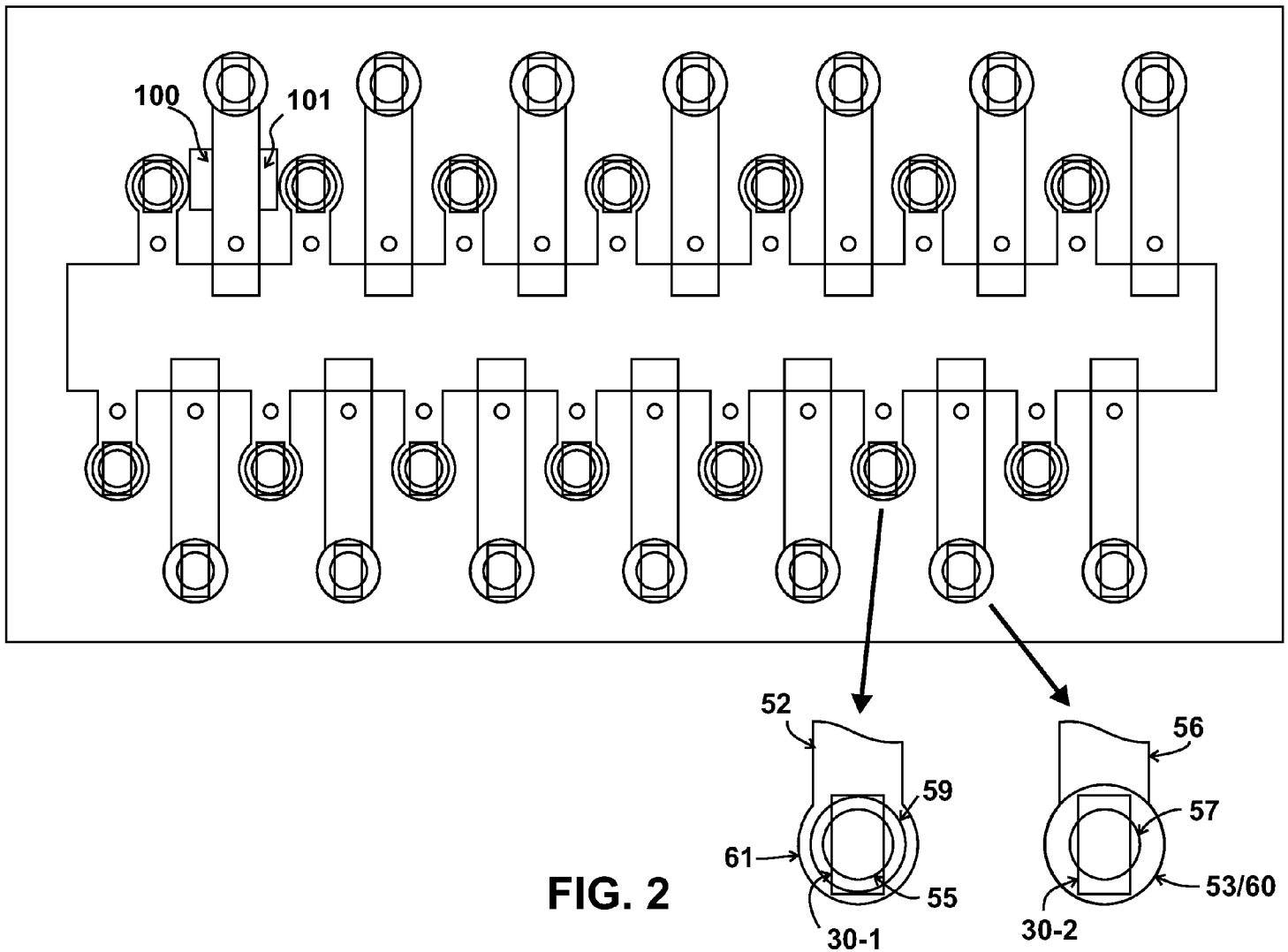
FIGS. 2 and 3 are diagrammatic views in accordance with the teachings of the present invention showing overlays of the nozzle covering.
Figure 3:
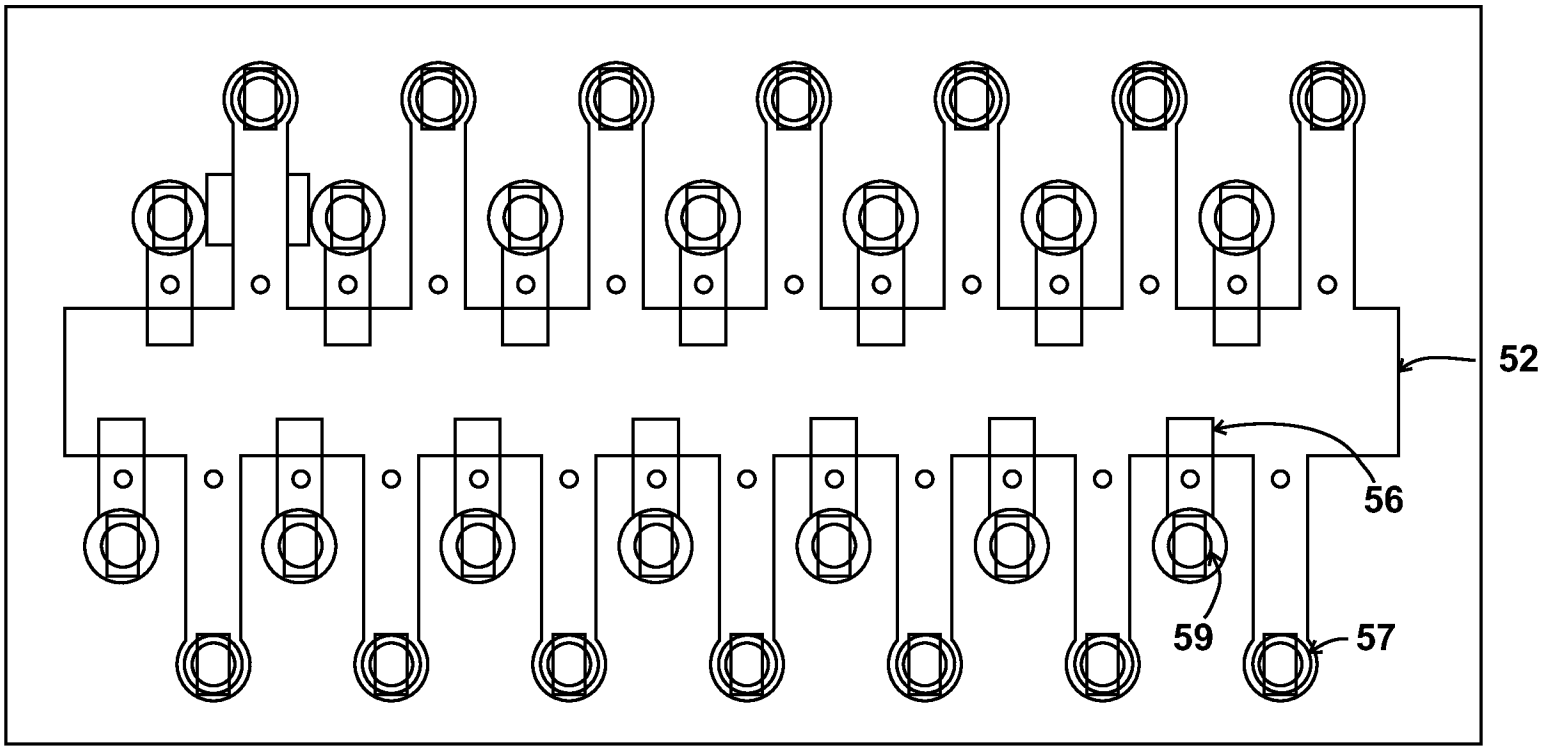

When stacked together, FIGS. 2 and 3 show the covering overlaid on the close and far firing elements 30-1, 30-2 of the substrate. FIG. 2 illustrates it according to the design of FIG. 1. FIG. 3 illustrates the alternate design with the lower layer 52 directing fluid to the farther elements while the medium layer 56 directs fluid to the closer elements. Similarly, the large and small openings 57, 59 of the upper layer register with the close and far firing elements, respectively. FIG. 3 simply reverses the functionality of the design in FIGS. 1 and 2. In either design, flow features remain elevated from one layer to a next layer. Chip strength is improved over the art and more room is made available for adhering surfaces together. Notwithstanding this, skilled artisans will recognize that the narrowest overlap exists between layers of the present design at elements 100 and 101 in FIG. 2. Challenges for adhesion will likely persist here.

Figure 4:
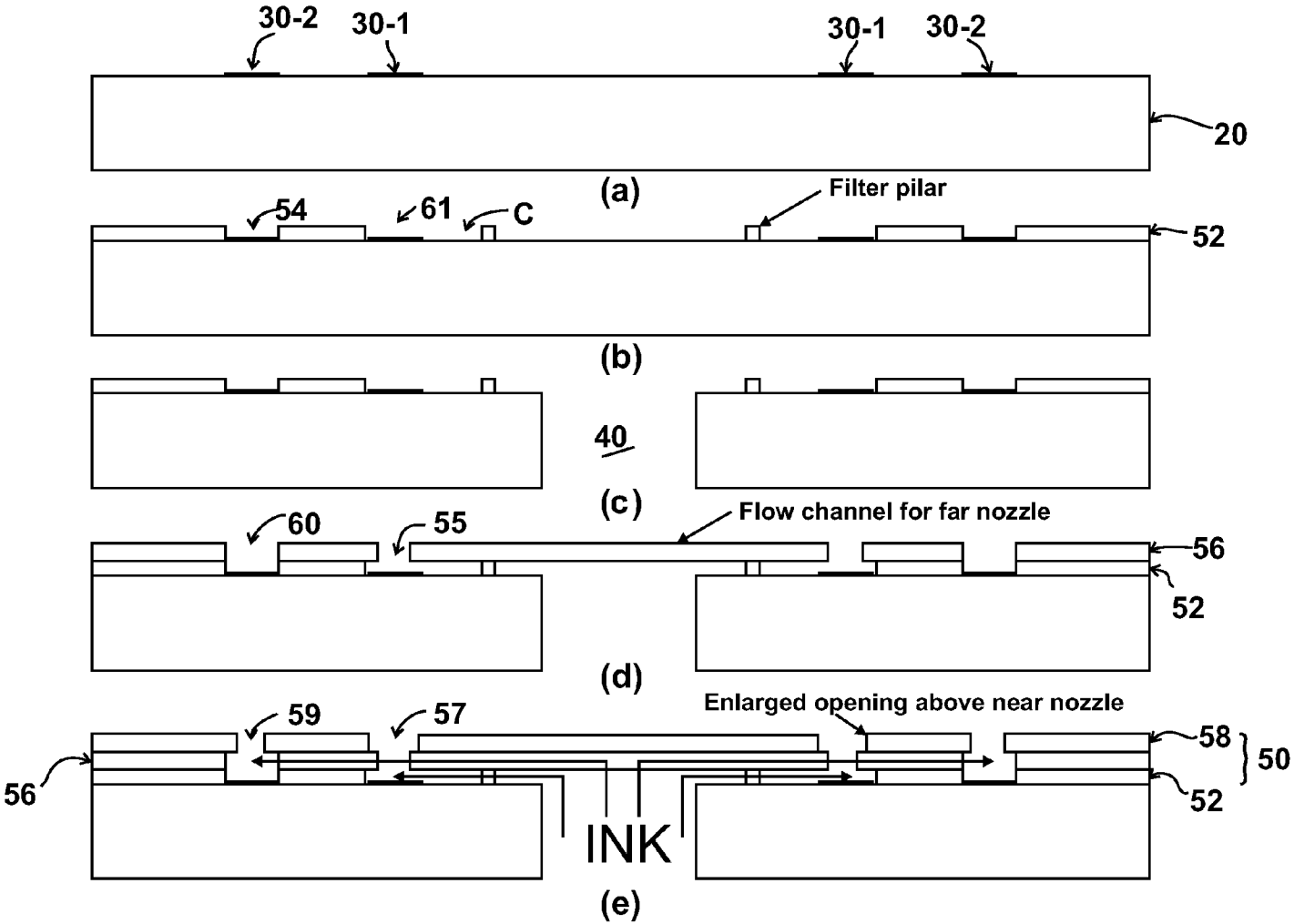
FIGS. 4-6 are diagrammatic views in accordance with the teachings of the present invention showing stepwise construction of various nozzle coverings.
Figure 5:
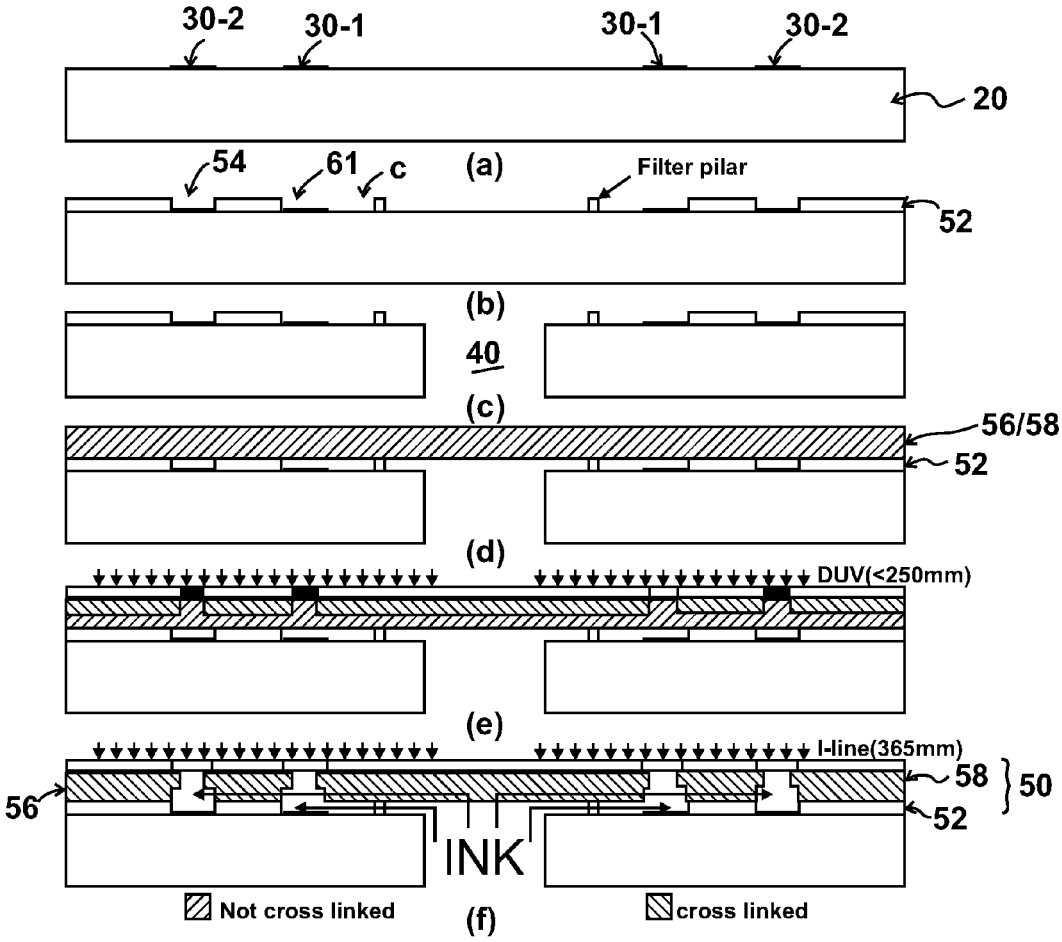
Figure 6:
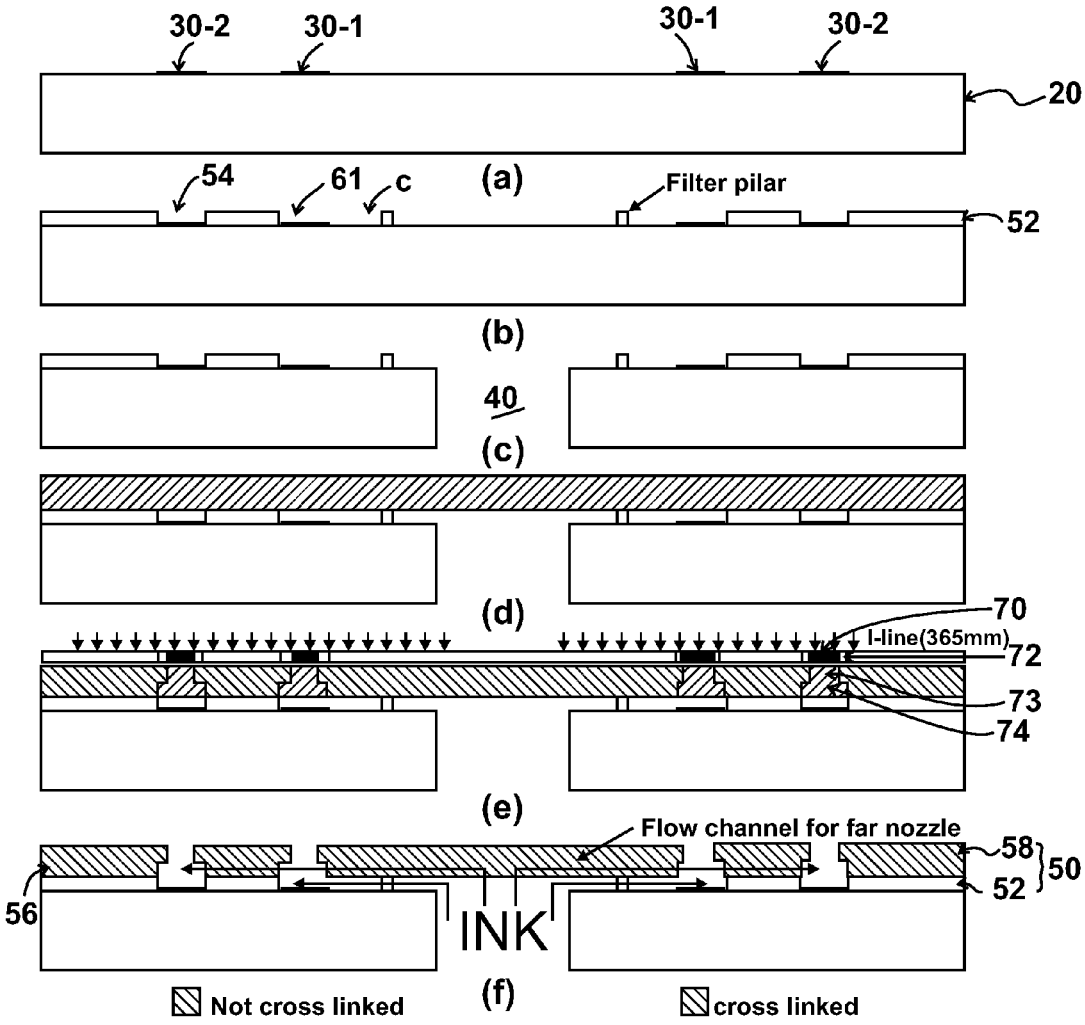

With reference to FIGS. 4-6, a variety of options are presented to construct the nozzle covering. For simplicity, however, only one configuration is shown. It corresponds to the close firing elements having flow features in the lower layer of the covering, while the far firing elements have flow features in a higher layer. Otherwise, the construction options remain valid for the alternate embodiment of FIG. 3.

With reference to FIG. 4, the fabrication of a covering 50 exploits double laminations of various polymers. At step a), a substrate 20 is fashioned with both close and far fluid firing elements 30-1, 30-2. At b), a lower layer 52 of the covering is "spin-coated" on the substrate. It includes patterning the fluid channels C to each of the close firing elements and creating bubble chambers 61. It also includes creating holes 54 for the far firing elements. At c), the fluid via 40 is etched through the substrate. This includes deep reactive ion etching (DRIE) or other processing. At d), the medium layer 56 is laminated as a polymer blank onto an upper surface of the lower layer 52. Patterning then occurs in the blank such that holes 55 reside in registration with the close firing elements and flow channels and bubble chambers 60 exist for the far firing elements. At e), an upper layer 58 is laminated onto the upper surface of the medium layer. Large and small size nozzle openings 57, 59 are then patterned to register with the close and far firing elements, respectively. The use of the larger openings also includes "extra" enlargement to avoid effects of misalignment in underlying layers.

During use, fluid (ink) flows to each of the close and far firing elements in two differing layers of the covering 50 and at two differing heights above the substrate. It ejects through the top layer after nucleation in a respective bubble chamber. The chambers can be similarly sized for each of the close and far firing elements despite fabrication in differing layers if uniform size of fluid drops is needed. The chambers can also be differently sized to eject large and small fluid drops respectively for high and low optical density printing. The layers are also 5-20 μm thick. The polymers are any of a variety, but include negative tone photo resists such as SU8 from Microchem, Polyimide among others.

In the construction option of FIG. 5, a single lamination of a polymer is contemplated in a multi-layer covering having plural instances of exposure. Processes a)-c) occur according to FIG. 4. At d), a layer 56/58 of polymer is laminated to an upper surface of the lower layer 52. It is relatively thick (10-30 μm) to define both the medium and upper layers. At e), a deep (<250 nm) UV exposure, having very limited penetrating depth in negative tone polymer, defines the features of the upper layer. At f), an i-line UV exposure (365 nm) defines the features of the medium layer. Ink then flows as shown.

In the construction option of FIG. 6, an alternative embodiment of single polymer lamination includes only a single instance of exposure. Processes a)-d) occur according to FIG. 5. At e), a gray scale mask is used to pattern both the upper and medium layers in a single i-line UV exposure (365 nm). The interior area 70 in the mask defines the upper layer patterns 73, while the entirety area 72 defines the medium layer patterns 74. At f), any unexposed polymer is removed in a chemical bath or other development process. Ink flows in the differing layers as shown.

Figure 7:
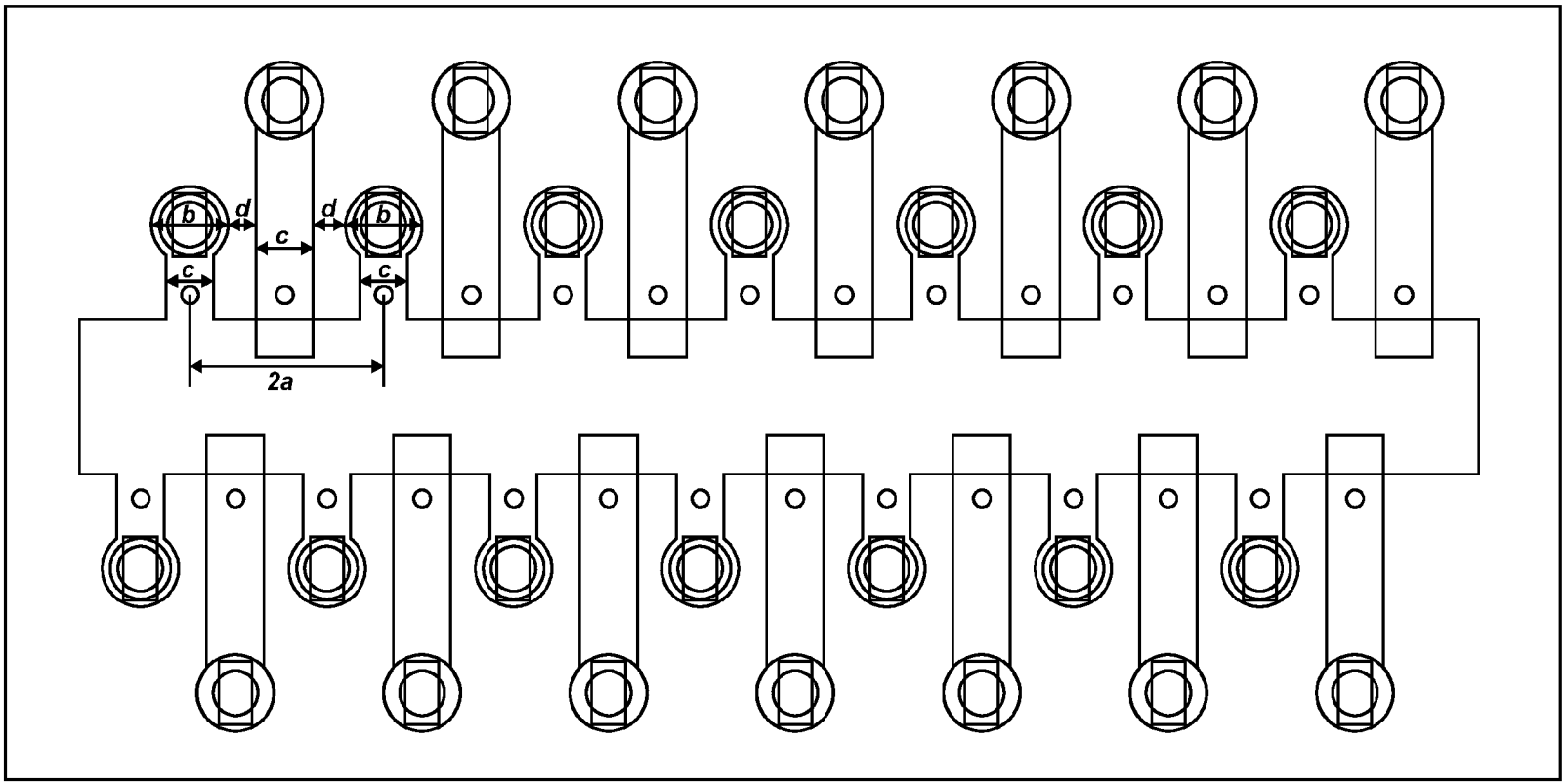
FIG. 7 is a diagrammatic view in accordance with the teachings of the present invention showing relative overlay dimensions in a representative nozzle covering layout.

With reference to FIG. 7, various dimensions are labeled for the multiple layers around the close and far firing elements. From geometry, $2a=b+c+2d$. In designs having $b=17$ μm, $c=14$ μm and $d=4$ μm, dimension "a" becomes 19.5 μm. It corresponds to spacing between close and far firing elements along the length of the via. It results in an imaging resolution of more than 2500 dpi (2605 dpi) in a single imaging pass, but does not sacrifice chip strength or improved adhesion characteristics. For at least this reason, the embodiments of the invention provide advantage over the state of the art.

The foregoing has been presented for purposes of illustrating the various aspects of the invention. It is not intended to be exhaustive or to limit the claims. Rather, it is chosen to provide the best illustration of the principles of the invention and its practical application to enable one of ordinary skill in the art to utilize the invention, including its various modifications that naturally follow. All such modifications and variations are contemplated within the scope of the invention as determined by the appended claims. Relatively apparent modifications include combining one or more features of various embodiments with one another.

The invention claimed is:

1. A micro-fluid ejection head, comprising:

a substrate;

a plurality of fluid firing elements on the substrate to eject fluid upon activation, individual fluid firing elements being positioned closer or farther to a fluid via common to the plurality of fluid firing elements; and a multiple layer covering defining nozzle openings corresponding to each of the individual fluid firing elements, wherein a lower layer of the covering directs the fluid to either of the closer or farther fluid firing elements while a higher layer of the covering directs the fluid to the other of the closer or farther fluid firing elements.

2. The ejection head of claim 1, further including fluid channels in the lower and higher layers of the covering extending from above the fluid via in the substrate to each of the closer and farther fluid firing elements.

3. The ejection head of claim 1, wherein the covering further includes a highest layer away from the fluid firing elements, the highest layer defining said nozzle openings in one of larger and smaller opening sizes for the individual fluid firing elements said positioned closer or farther to the fluid via.

4. The ejection head of claim 1, further including a lengthy fluid via opening in only the lower layer of the covering corresponding to a length of the fluid via in the substrate.

5. The ejection head of claim 2, wherein the higher layer covers the fluid channels in the lower layer.

6. The ejection head of claim 3, wherein the lower layer has holes corresponding to either the larger or smaller opening sizes of the highest layer, the holes having a size smaller or larger the opening sizes, respectively.

7. The ejection head of claim 3, wherein the higher layer has holes corresponding to either the larger or smaller opening sizes of the highest layer, the holes having a size smaller or larger the opening sizes, respectively.

8. The ejection head of claim 4, wherein the higher layer covers the lengthy fluid via opening in the lower layer.

9. The ejection head of claim 5, wherein the covering further includes a highest layer away from the fluid firing elements, the highest layer covering the fluid channels in the higher layer.

10. A micro-fluid ejection head, comprising:

a substrate;

a plurality of fluid firing elements on the substrate to eject fluid from a fluid via upon activation; and a multiple layer covering on the substrate defining nozzle openings corresponding to each of the fluid firing elements, a lower layer of the covering having first channels to direct the fluid to a first portion of the fluid firing elements while a higher layer of the covering has second channels to direct the fluid to a second portion of the fluid firing elements.

11. The ejection head of claim 10, wherein the higher layer covers the first channels in the lower layer.

12. The ejection head of claim 10, wherein the covering further includes a highest layer away from the fluid firing elements, the highest layer defining said nozzle openings in one of larger and smaller opening sizes for the each of the fluid firing elements.

13. The ejection head of claim 11, wherein the covering further includes a highest layer away from the fluid firing elements, the highest layer covering the second channels in the higher layer.

14. The ejection head of claim 12, wherein the lower and higher layers have holes corresponding to either the larger or smaller opening sizes of the highest layer, the holes being oppositely sized in the lower and higher layers.

15. A micro-fluid ejection head, comprising:

a substrate;

a plurality of fluid firing elements on the substrate to eject fluid from a fluid via upon activation; and a multiple layer covering on the substrate defining nozzle openings corresponding to each of the fluid firing elements, a lower layer of the covering having first channels to direct the fluid to the fluid firing elements at a first height above the substrate and a higher layer of the covering having second channels to direct the fluid to the fluid firing elements at a second height above the substrate.

16. A micro-fluid ejection head, comprising:

a substrate;

a plurality of fluid firing elements on the substrate to eject fluid upon activation; and a multiple layer covering on the substrate having nozzle openings corresponding to the fluid firing elements wherein fluid is directed through individual layers of the covering at two different heights above the substrate.

17. The ejection head of claim 16, wherein a higher of the individual layers covers fluid channels in a lower of the individual layers.

18. The ejection head of claim 16, wherein the covering defines said nozzle openings in one of larger and smaller opening sizes for individual ones of the fluid firing elements.

19. The ejection head of claim 16, wherein the fluid firing elements are arrayed closer or farther to a fluid via in the substrate common to each of the fluid firing elements.

20. The ejection head of claim 19, wherein a lower layer of the covering directs the fluid to either of the closer or farther fluid firing elements while a higher layer of the covering directs the fluid to the other of the closer or farther fluid firing elements.

* * * * *